US005960502A

United States Patent [19]

Sherman et al.

[11] Patent Number: 5,960,502

[45] Date of Patent: Oct. 5, 1999

[54] METHOD AND MECHANISM FOR ERECTION OF PREFABRICATED MODULAR DECK OF VIADUCTS, MOTORWAY FLYOVERS AND THE LIKE

[76] Inventors: Yury Sherman, 511 Beech St., Roslindale, Mass. 02131; Mark Yankelevich, 11 Embassy Rd., Apt 23, Brighton, Mass. 02135-4631; Mikhail Buff, 6630 Cameron Ct., Brooklyn, N.Y. 11204

[21] Appl. No.: 08/896,562

[22] Filed: Jul. 18, 1997

[51] Int. Cl.[6] ..... E01D 21/00

[52] U.S. Cl. ..... 14/77.1

[58] Field of Search ..... 14/77.1; 404/48; 52/745.2, 745.06, 127.2, 126.5, 126.6

[56] References Cited

U.S. PATENT DOCUMENTS 3,882,564 5/1975 Muller ..... 14/77.1 X

*Primary Examiner*—Tamara L. Graysay
*Assistant Examiner*—Sunil Singh

[57] ABSTRACT

A method for erection by launching of prefabricated modular deck of viaducts, motorway flyovers and the like and a mechanism for performing the method. The mechanism is a mobile bridge including towers and a replaceable platform supported by the towers. Each tower consists of a set of telescopic sections moveable up and down, placed on a track. Carrying capacity and structure of the bridge provide supporting and lowering the deck module and its carrier. The platform which length is less than a distance between the viaduct piers has expandable ends. To increase stability of the bridge during the erection process the platform can be temporarily affixed to the viaduct. The method is performed as a set of steps. Steps 1 and 2—installing the bridge between viaduct piers to provide a continuous way from an existing part of the viaduct to the bridge. Steps 3 and 4—delivering the module to the place of erection using an existing part of the viaduct as a road. Pulling the module carrier over the bridge and positioning the module carrier such that the module is located directly above places on the piers where it should be set. Step 5—setting the module on the piers by lowering the platform. Steps 6 and 7—replacing the bridge to the next working position and installing it in steps 1 and 2. Three versions of the invention related to particular applications of the method are developed.

14 Claims, 6 Drawing Sheets

METHOD AND MECHANISM FOR ERECTION OF PREFABRICATED MODULAR DECK OF VIADUCTS, MOTORWAY FLYOVERS AND THE LIKE

BACKGROUND OF THE INVENTION

Known methods for erection of prefabricated modular deck of viaducts, motorway flyovers and the like are based on using cranes of high carrying capacity. The methods have drawbacks:

- installation and operation of the cranes require large space. As a result, erection process is extremely difficult in cramped areas;
- erection of the deck along or across existing roads hinders the traffic;
- high carrying capacity cranes used for the erection are expensive.

It is also known the method for erection by launching, broadly used for construction of modular plants. The modules have huge sizes and weight up to 1500–2000 t. The erection process is performed as following:

- completely assembled module is delivered from an assembly site to the site of erection by trailer with moveable (up and down) platform,
- the trailer is positioned such that the module is located directly above the foundation where it should be installed, and
- the module is set on the projected place by downing the trailer's platform.

Neither large space for erection nor expansive cranes are required. However, this method isn't used for erection of viaducts and motorway flyovers because it isn't adopted to specifics of these structures and there is no equipment for performing the method if modules are highly elevated above the ground.

SUMMARY OF THE INVENTION

The objects of the present invention are a method for erection by launching of prefabricated modular decks of viaducts and motorway flyovers and a mechanism for performing the method.

The mechanism is a mobile bridge consisting of two towers and a replaceable platform supported by the towers. Each tower has a track providing its mobility and, accordingly, mobility of the bridge. The last can be moved as a complete structure or by elements: the towers and the platform separately.

Each tower consists of a set of telescopic sections moveable up and down, for example, by hydraulic jacks. An expanded position of sections can be fixed.

Viaduct piers should not be an obstacle for up and down movement of the bridge, therefore, length of the platform is less than a distance between the piers. To provide continuous way for pulling the module carrier from the existing viaduct deck to the bridge the platform has expandable ends.

The method is performed as a set of steps.

Steps 1 and 2 are intended for preparation to the erection process. They include installation of the bridge between two piers where the module is to be erected. As the main procedures of the installation the process includes leveling the bridge with the top of the existing part of the viaduct and expanding end(s) of the platform and affixing it to the viaduct. Thus, continuous way from the viaduct to the bridge is provided.

During steps 3 and 4 the module is delivered from an assembly site using the existing part of the viaduct as a road. Then, the module carrier is pulled over the bridge and positioned such that the module is located directly above places of the viaduct piers where it should be finally set.

Setting the module on the piers is performed at step 5 by downing the platform. After the module is set, the platform with carrier upon it continues to down until it reaches the lowest level above the ground provided by the bridge structure.

During steps 6 and 7 the bridge with the carrier is replaced to the next pair of the viaduct piers where the next module should be erected. Then the bridge is installed as in steps 1 and 2 and the carrier is moved back to the assembly site for charging with another deck module.

The second version of the method considers a case when the module is delivered by, a trailer and a driving tractor which total length is more than the distance between the viaduct piers. In this case two bridges are installed between two successive pairs of the viaduct supports.

As the third version of the method it is considered an erection of the modules at intersection of the viaduct and a road elevated above the ground. In this case the bridge is assembled on the place of erection.

The fourth version of the method is its application for erection of motorway flyovers.

DETAIL DESCRIPTION OF THE PREFERRED EMBODIMENT

Figure 1:
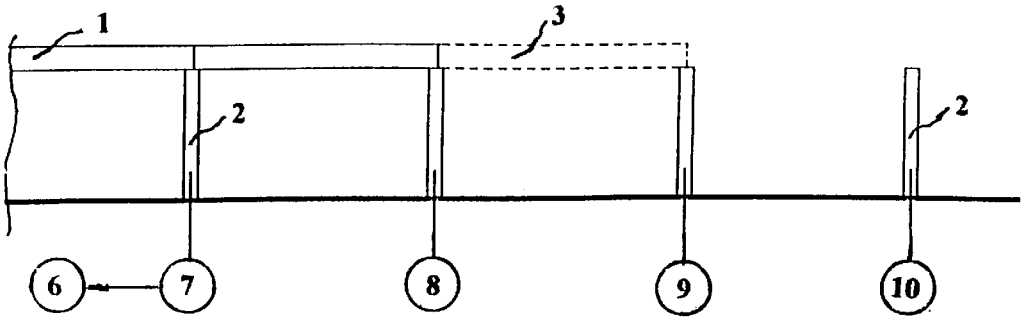
FIG. 1 is a scheme of the viaduct with a partly erected deck and piers upon which modules of the deck should be erected.

Referring to the drawings in more details, in FIGS. 1–18 a method for erection by launching of prefabricated modular decks of viaducts and motorway flyovers and a mechanism for performing the method are shown.

The method is being described on an example of a viaduct shown in FIG. 1. The viaduct piers 2, as well as part 1 of the deck (in front of grid line 8) had been erected. The module 3 should be erected between grid lines 8–9.

Figure 2:
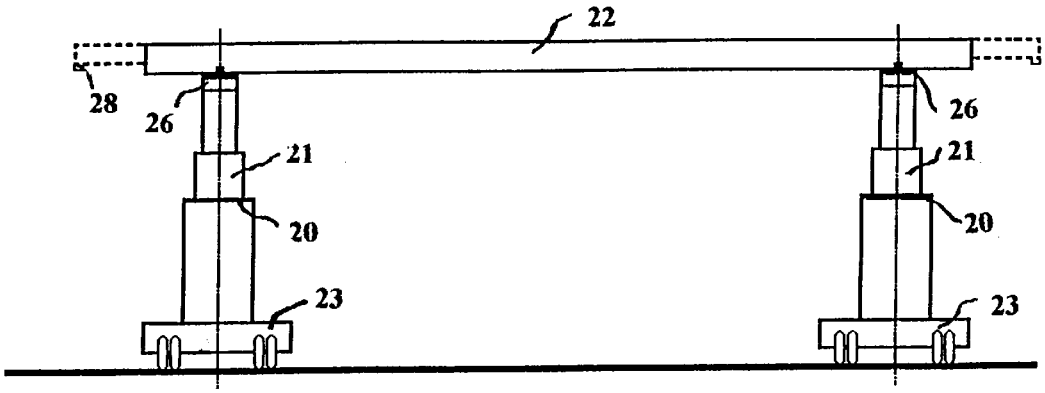
FIG. 2 is a front view of the bridge providing performance of the method.
Figure 3:
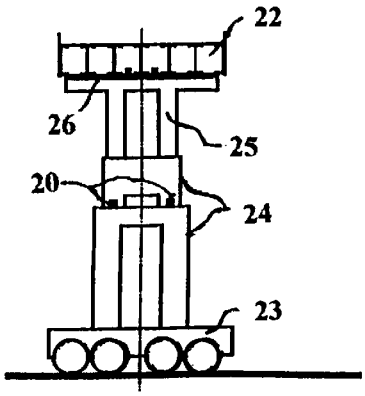
FIG. 3 is a cross section of the bridge shown in FIG. 2.

Reference first will be made to FIGS. 2 and 3 which show a mechanism for performing the erection process in accordance with the invention.

The mechanism is a mobile bridge (FIG. 2). It consists of two towers 21 and removable platform 22 supported by the towers. Mobility of the bridge is provided by trucks 23 on which the towers are set. The bridge can be moved as a whole or by elements. In last case it is assembled on the place of erection.

Each tower includes a set of telescopic sections 24 (FIG. 3) and means for moving them up and down, for example, hydraulic jacks. There are also means 20 for fixing an expanded position of the sections 24. Top section 25 has means 26 for affixing the platform to the tower.

The platform 22 (FIG. 3) carries the module and its carrier which are pulled over the platform. In its working position the platform is leveled with the top of part 1 of the viaduct. Therefore, to avoid obstacle for up and down movement of the platform its length should be less than the distance between the viaduct piers. Expandable ends 27 of the platform provide a continuous way for pulling the module carrier over the platform. To increase stability of the bridge and to transfer horizontal loads applied to the bridge to the viaduct piers the end(s) 27 is affixed to the viaduct by means 28.

Successive steps of erection of the viaduct deck in accordance with the method is described with reference to FIGS. 4–17.

Figure 4:
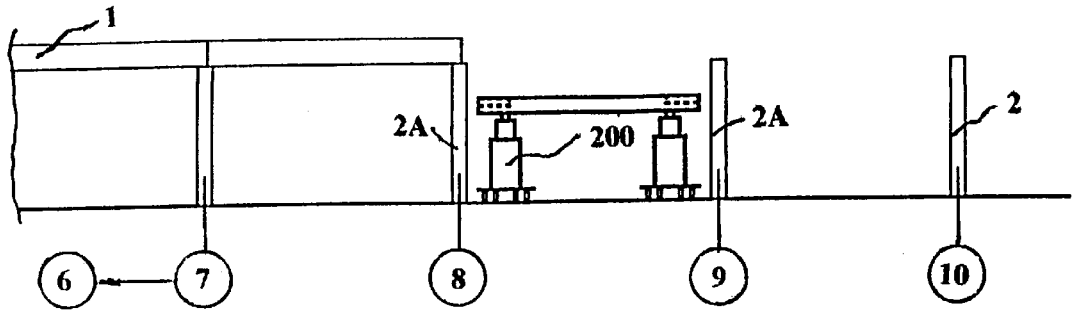
FIGS. 4–10 are schemes of steps 1–7 of the method.

FIG. 4 shows step 1 of the process during which the bridge 200 is placed between pair of viaduct piers 2A (grid lines 8–9) where the module 3 (FIG. 1) should be erected.

Figure 5:
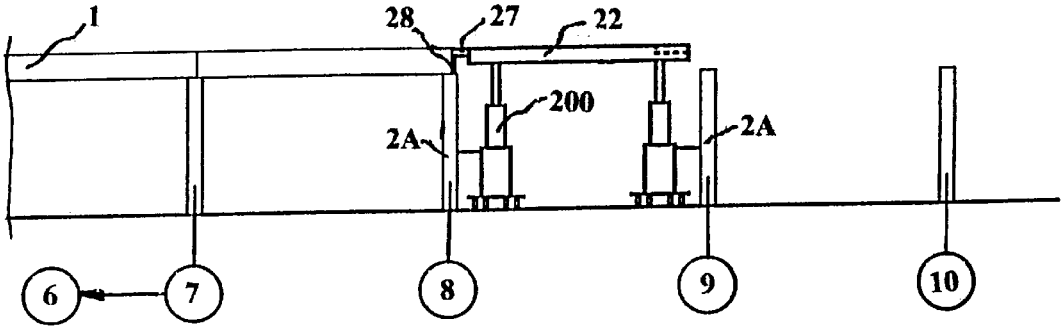

FIG. 5 shows step 2 at which the bridge 200 is prepared for the erection process. The platform 22 is being elevated until it is leveled with the deck of the existing part 1 of the viaduct. The end 27 faced to the part 1 is being expanded until it reaches the viaduct deck. Thus, continuous way from the viaduct to the bridge is provided. Means 28 of the end 27 is affixed to the viaduct.

Figure 6:
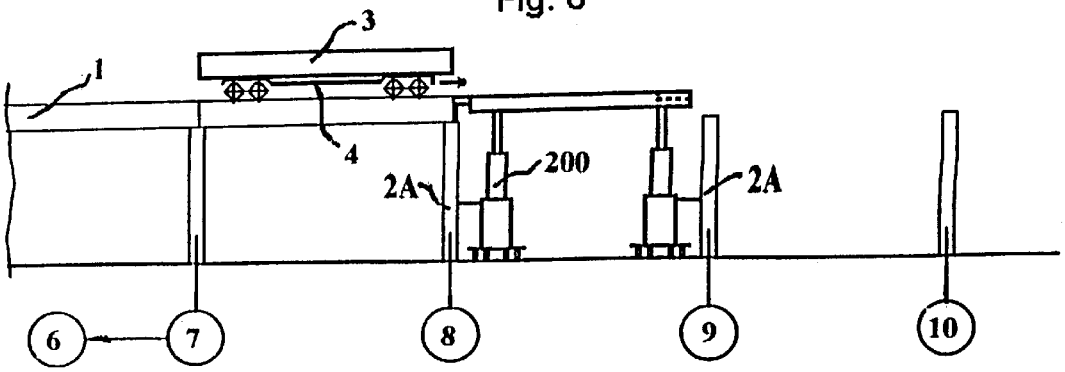

FIG. 6 shows step 3 at which the module 3 is delivered from an assembly site to the place of erection using the existing part 1 of the viaduct as a road. By this way the module is elevated above the piers 2A where it should be set. The module can be carried by a trailer 4 or any other appropriate transportation means.

Figure 7:
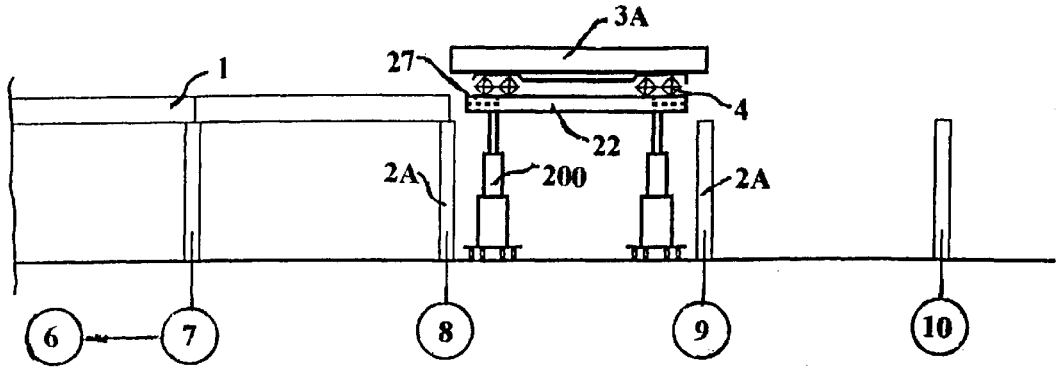

FIG. 7 shows step 4 at which the trailer 4 with the module 3 upon it is pulled over the platform 22 and positioned such that the module is located directly above the places on the piers where it should be set. Then, the trailer is attached to the bridge 200, the expanded end 27 is detached from the viaduct and retracted into the platform 22.

Figure 8:
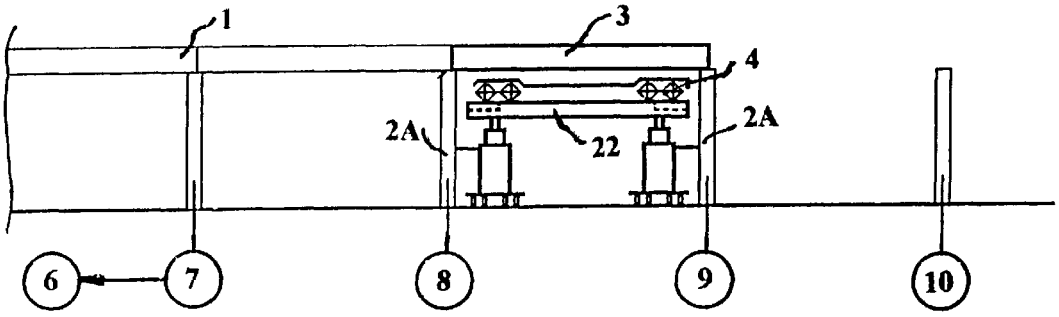

FIG. 8 shows step 5 at which the platform 22 with the trailer 4 and the module 3 is downed. Just before the module 3 is set on the viaduct piers it was detached from the trailer 4. By further downing of the platform the module 3 sits on the piers and the trailer 4 is released from the module. The platform 22 continues to go down until it reaches the level suitable for transportation to the next pair of piers.

Figure 9:
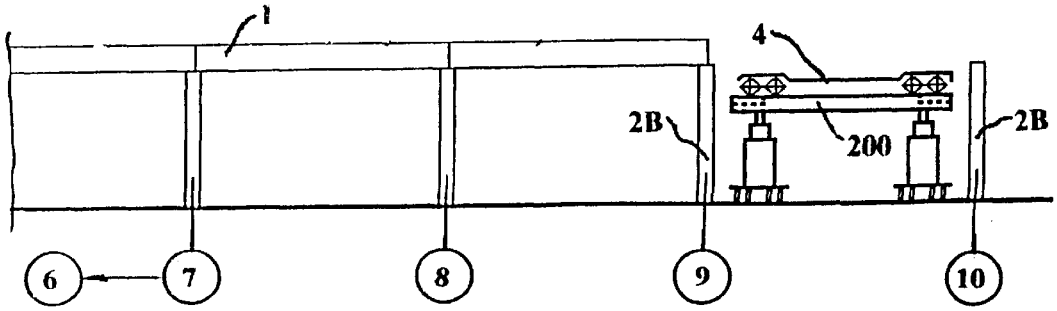

FIG. 9 shows step 6 at which the bridge with the trailer 4 upon it is moved to grid lines 9–10 (piers 2B) where the next module will be erected, or moved transverse if another module, parallel to module 3, should be set between grid lines 8–9. Then the bridge is installed as described in Step 2.

Figure 10:
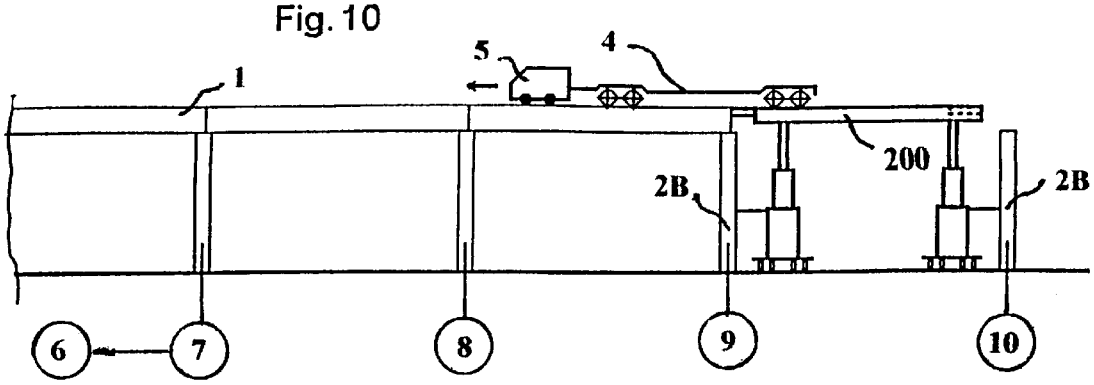

FIG. 10 shows step 7 during which the trailer 4 is detached from the bridge and is moved to the assembly site by tractor 5 or by any other convenient means for charging with another module. Newly erected module 3 and part 1 of the viaduct are used as a road.

If the length of the module carrier is more than the distance between the viaduct piers, for example, the trailer 4 is driven by a tractor 5, the method is modified according to the second version of the invention.

Figure 11:
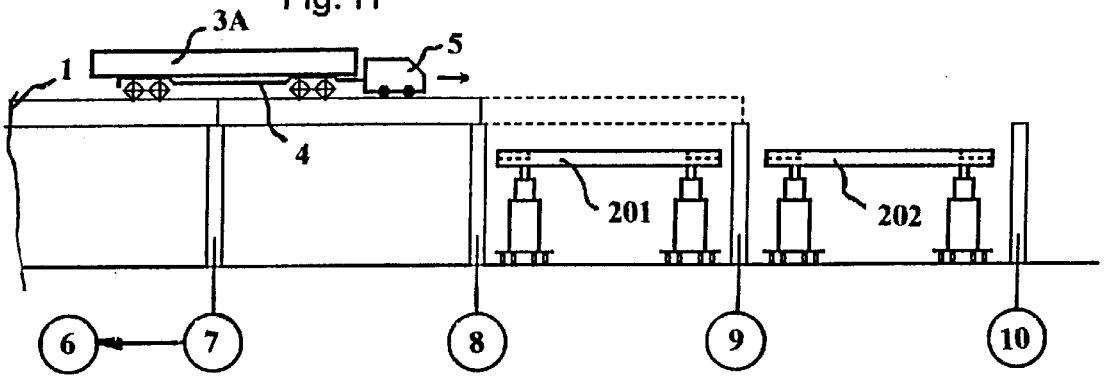
FIGS. 11–14 are schemes of steps 1.2–7.2 of the method.

Step 1.2—between two successive pairs of viaduct piers (grid lines 8–9 and 9–10) where the deck modules should be set, two bridges 201 and 202 are placed (FIG. 11).

Figure 12:
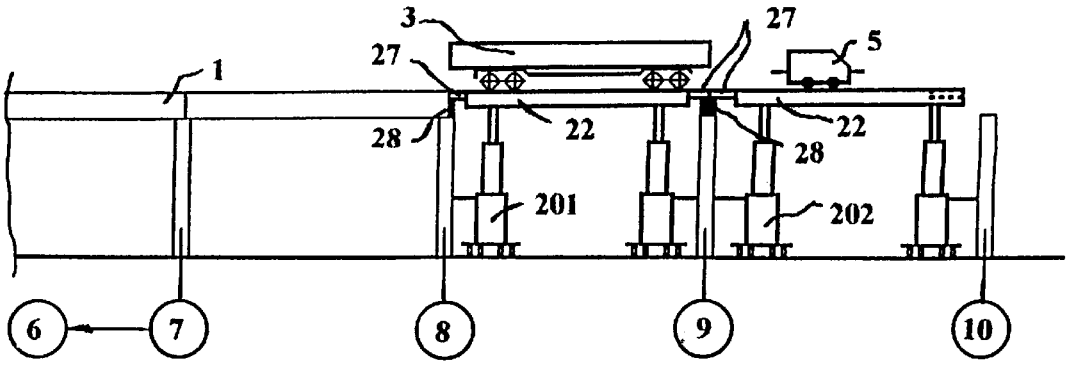

Step 2.2—similar to step 2 for both bridges 201 and 202 (FIG. 12). The platforms 22 are being elevated until they are leveled the deck of the existing part 1 of the viaduct. The end 27 of the bridge 201, faced to the part 1, is expanded until it reaches the viaduct deck. The ends 27 of both bridges faced to the intermediate viaduct pier are also being expanded until they meet each other. Thus, continuous way from the viaduct to the bridge 202 is provided. Means 28 of the ends 27 are affixed to the viaduct and the intermediate pier.

Step 3.2—as in Step 3 (FIG. 11).

Step 4.2—similar to Step 4 except of the trailer 4 is pulled over the bridge 201 and the tractor 5 over the bridge 202 (FIG. 12).

Figure 13:
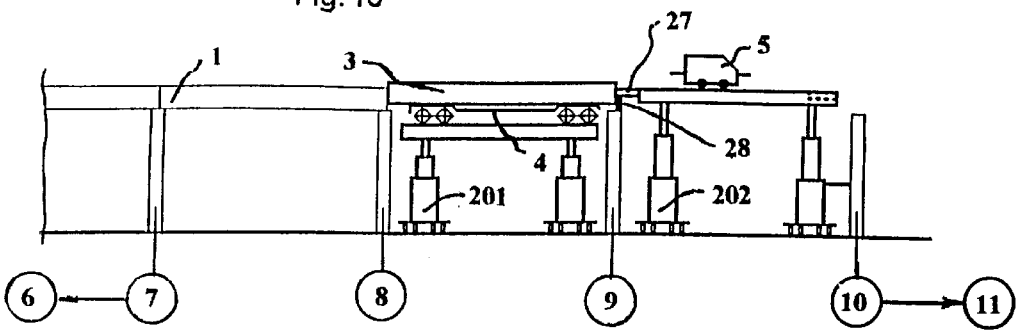

Step 5.2—similar to Step 5 for the bridge 201. The bridge 202 is not activated (FIG. 13).

Step 6.2—as in Step 6 for the bridge 201 which is moved to the viaduct piers between grid lines 10–11. The bridge 202 is not activated.

Figure 14:
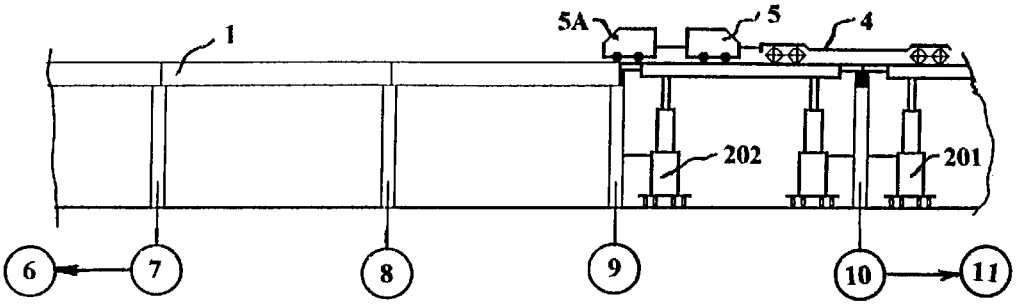

Step 7.2—the trailer 4 is detached from the bridge 201, attached to the tractor and replaced by the tractor 5A to the assembly site for charging with another module (FIG. 14).

Figure 15:
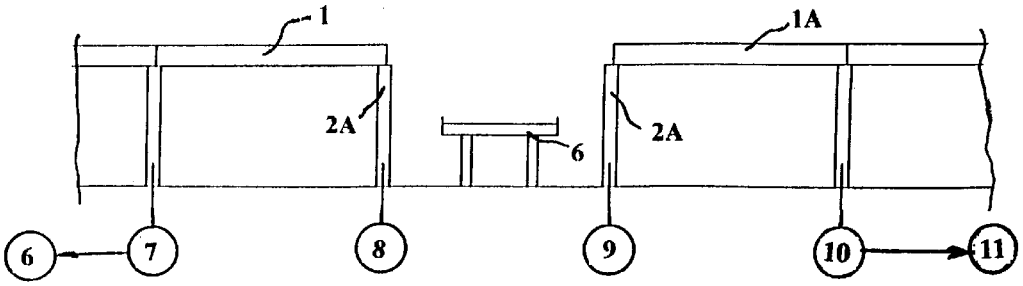
FIGS. 15–16 are schemes of steps 1.3–7.3 of the method.

The third version of the method describes the case when the viaduct intersects a road 6 elevated above the ground (FIG. 15). Parts 1 and 1A of the viaduct on the left and the right sides of the road 6 have already been erected. Module 3 should be erected between these parts.

Figure 16:
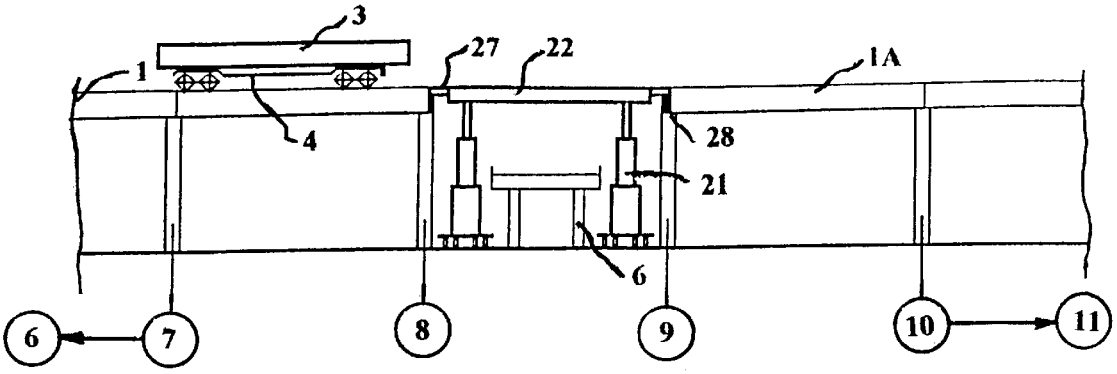

Step 1.3—towers 21 of the bridge are placed at both sides of the road 6 (FIG. 16). The towers are expanded until their tops are above the road 6. The platform 22 is delivered through road 6 and mounted upon the towers by crane installed on the road.

Step 2.3, 3.3, 4.3—similar to Steps 2, 3, 4.

Figure 17:
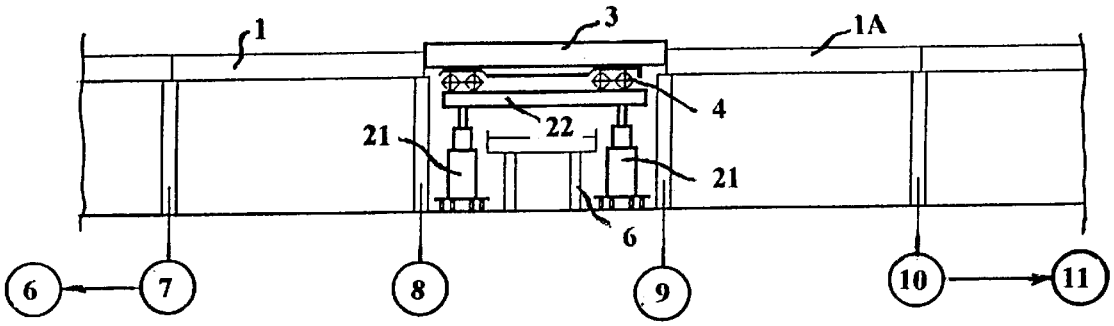
FIGS. 17, 18 are schemes of application of the method for erection of motorway flyovers.

Step 5.3—similar to Step 5 except the platform 22 is being moved down until its level becomes appropriate for removing the platform from the bridge 200 (FIG. 17).

Step 6.3—the trailer 4 and the platform 22 are removed successively from the bridge and transported out of the intersection. Then, the towers 21 are also moved away.

Figure 18:
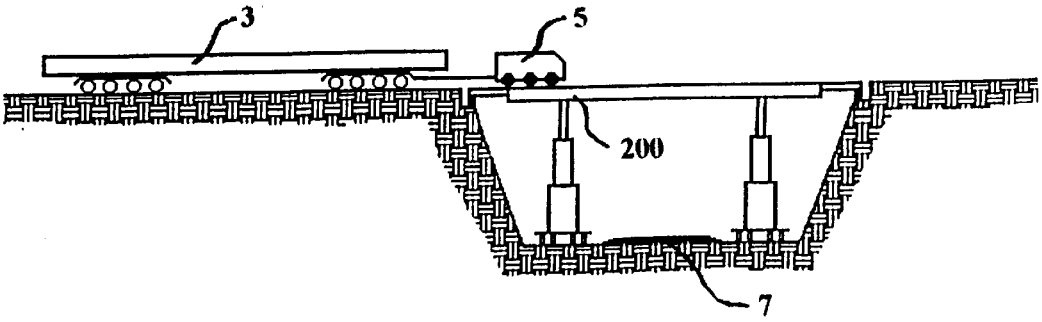

In case of erection of motorway flyovers some insignificant changes of the method are required (FIG. 18). The bridge is placed on the down road 7 between embankments of the flyover or between the embankment and an intermediate pier of the flyover. The upper road, the flyover belongs to, is used for delivery of the module to a place of erection. In other aspects the process is similar to described in the first version.

This invention is not limited to the details shown since various modifications and structural changes are possible without departing in any way from the spirit of the present invention. What is desired to be protected is set forth in particular in the appended claims.

What is claimed is:

1. A method for erection of prefabricated modular deck of viaducts or motorway flyovers with at least one pair of supports a deck module to be set on and a road leading to at least one of said supports, providing delivery of said deck module to said supports such that when the deck module placed on its carrier reaches said supports the deck module is located above them, comprising the following successive steps:

installing a mobile bridge consisting of at least two towers moveable up and down and a platform with at least one expandable end, between said supports, under the place where the module should be erected;

moving the platform up until its top surface is leveled with a top surface of said road;

expanding at least one expandable end of the platform faced to said road such that said road and the platform form a continuous way;

delivering the deck module to said supports by its carrier using said road, pulling the carrier of the module over the platform;

positioning the carrier on the platform such that the module is located directly above the places of said supports on which the module should be set;

retracting the expandable end(s) of the platform and lowering the platform with the deck module and its carrier until the module is set on said supports; and continuing to lower the platform with the carrier released from the module until it reaches the level suitable for moving the bridge and the carrier away from position between said supports.

2. The method in accordance with claim 1, wherein said bridge is moved to the next pair of the supports where the next deck module should be erected, the top surface of the platform is leveled with the top of the newly erected module, and the carrier of the module is moved away from the bridge using the newly erected module and the road leading to said supports as a road.

3. The method in accordance with claim 1, wherein said bridge is moved transverse between said pair of supports and installed between said supports, under the place where the next module should be erected, the top surface of the platform is leveled with the top surface of the road, and the carrier of the module is moved away from the bridge using the road leading to said supports.

4. The method in accordance with claim 1, wherein the carrier is removed from the bridge.

5. The method in accordance with claim 1, wherein said expandable end(s) of the platform is affixed to a road structure such that the horizontal loads applied to the bridge are transferred to said road structure.

6. The method in accordance with claim 1, wherein said bridge is assembled before delivery to said pair of supports and is transported as a complete structure.

7. The method in accordance with claim 1, wherein the towers and the platform of said bridge are transported between said pair of supports separately and are assembled at the place of erection.

8. A method for erection of prefabricated modular deck of viaducts or motorway flyovers with a road elevated above the ground crossing the viaduct, at least one pair of supports a deck module to be set on, a road leading to at least one of said supports, providing delivery of said deck module to said supports such that when the deck module placed on its carrier reaches said supports the deck module is located above them, comprising the following successive steps:

installing a mobile bridge consisting of at least two towers moveable up and down and a platform with at least one expandable end between said supports under the place where the module should be erected, such that said towers are located left and right from the elevated road and the platform is located above the elevated road;

moving the platform up until its top surface is leveled with a top surface of said road;

expanding at least one expandable end of the platform faced to said road such that said road and the platform form a continuous way;

delivering the deck module to said supports by its carrier using said road, and pulling the carrier over the platform;

positioning the carrier on the platform such that the module is located directly above the places of said supports on which the module should be set;

retracting the expandable end(s) of the platform and lowering the platform with the deck module and its carrier until the module is set on said supports; and continuing to lower the platform with the carrier released from the module until it reaches the level suitable for moving the bridge and the carrier away from position between said supports.

9. A method for erection of prefabricated modular deck of viaducts or motorway flyovers with at least first and second successive pairs of supports having one common support the deck modules are to be set on, a road leading to at least one of said supports, providing delivery of said deck modules to said supports such that when each of said deck modules placed on its carrier reaches said supports the deck module is located above them, the carrier of said modules which including a trailer and a tractor which total length is more than the distance between pair of said supports, comprising the following successive steps:

installing the first and the second mobile bridges each of which consisting of at least two towers moveable up and down and a platform with at least one expandable end, between said first and said second successive pairs of supports, accordingly, under the place where the modules should be erected;

leveling the top surfaces of the platforms of the bridges with the surface of said road leading to the supports;

expanding at least one expandable ends of the platforms of the bridges such that the road and the platforms form a continuous way;

delivering the deck module to said first pair of supports by said trailer and tractor using said road;

pulling the trailer over the platform of the first bridge and the tractor over the platform of the second bridge;

positioning the trailer on the platform such that the first module is located directly above the places of said first pair of the supports where the module should be set on;

retracting the expandable ends of the first bridge and lowering its platform with the deck module and the trailer until the module is set on said first pair of the supports; and continuing to lower the platform of the first bridge with the trailer released from the module until it reaches the level suitable for moving the bridge and the trailer away from said first pair of supports.

10. The method in accordance with claim 9, wherein said first bridge is moved to the pair of supports following the second pair of supports, the platform of the first bridge is leveled with the top surface of the platform of the second bridge, and the trailer and the tractor are moved away from the bridges using the newly erected module and the road leading to said supports as a road.

11. The method in accordance with claim 9, wherein said trailer is removed from said first bridge.

12. The method is accordance with claim 9, wherein said expandable ends of the platforms are affixed to a structure of said road and to said common support such that the horizontal loads applied to the bridges are transferred to said structure of said road and said common support.

13. The method in accordance with claim 9, wherein said first and said second bridges are assembled before delivery to said pairs of supports and are transported as a complete structure.

14. The method in accordance with claim 9, wherein the towers and the platforms of said first and second bridges are delivered to said pairs of supports separately and are assembled on the place of the module erection.

* * * * *